US007125280B1

(12) United States Patent
Lee et al.

(10) Patent No.: US 7,125,280 B1
(45) Date of Patent: Oct. 24, 2006

(54) ELECTRICAL CONNECTOR ASSEMBLY

(75) Inventors: Shih-An Lee, Tu-Cheng (TW); Kuo-Chin Lin, Tu-Cheng (TW); Kai-Hsiang Chang, Tu-Cheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 11/405,611

(22) Filed: Apr. 18, 2006

(51) Int. Cl.
*H01R 3/00* (2006.01)

(52) U.S. Cl. ..... 439/490

(58) Field of Classification Search ..... 439/488–490, 439/676, 344
See application file for complete search history.

(56) References Cited

U.S. PATENT DOCUMENTS 6,478,611 B1 11/2002 Hyland
6,645,000 B1 * 11/2003 Sato et al. ..... 439/490
6,729,906 B1 * 5/2004 Simmons et al. ..... 439/607
6,776,651 B1 * 8/2004 Liu ..... 439/490
6,910,917 B1 * 6/2005 Chen ..... 439/541.5
6,962,511 B1 * 11/2005 Gutierrez et al. ..... 439/676
6,984,155 B1 * 1/2006 Liu ..... 439/676

* cited by examiner

*Primary Examiner*—Khiem Nguyen
(74) *Attorney, Agent, or Firm*—Birch, Stewart, Kolasch and Birch, LLP

(57) ABSTRACT

An electrical connector assembly for soldering with a PCB and connecting to a plug includes an insulating housing containing a terminal module and a LED module. The terminal module includes a base containing a plurality of terminals. Each terminal has a body, a contacting portion extended upwardly from one end of the body for mating with the plug, a soldering portion bent rearwards from the other end of the body for soldering with the PCB. The LED module includes a pair of conduction terminals. Each conduction terminal has a post, a contacting portion extended frontward from one end of the post for connecting to a LED element, a soldering portion bent rearwards from the other end of the post for soldering with the PCB. Additionally, the soldering portions of the terminals and the conduction terminals are arranged at same plane for soldering with the PCB by surface mount technology.

17 Claims, 5 Drawing Sheets

ELECTRICAL CONNECTOR ASSEMBLY

BACKGROUND OF THE INVENTION

1. Field of the Invention

The invention relates to an electrical connector assembly, and particularly to an electrical connector assembly capable of soldering with a print circuit board by surface mount technology.

2. The Related Art

Considering cost and throughput, manual facture is not adopted by conventional manufacturing industries. With rapid development of manufacturing technology, manufacturing factures are adopted by the manufacturing industries. One kind of the manufacturing factures is surface mount technology capable of high precision, high throughput and automatic manufacturing procedure, which is adopted by the manufacturing industries.

A conventional electrical connector is disclosed in U.S. Pat. No. 6,478,611. The electrical connector includes an insulating body containing a terminal module, a pair of light-emitting diode (LED) modules and a metal shell containing the insulating body. The insulating body has a pair of channels in both sides and a pair of holes under the channels. Each the LED module includes a fixing device and a LED element respectively received in the channels and the holes. Soldering portions of the terminal module and soldering portions of the LED module are perpendicular to a printed circuit board, which are manually inserted into corresponding through holes formed in the printed circuit board. However, the electrical connector engaging with the printed circuit board by manually inserting has low throughput and high human cost.

SUMMARY OF THE INVENTION

An object of the present invention is to provide an electrical connector assembly capable of soldering with a print circuit board by surface mount technology.

According to the invention, the electrical connector assembly comprises an insulating housing, a terminal module and a light-emitting diode (LED) module. The insulating housing defines a top wall, a bottom wall opposite to the top wall, two side walls and a rear wall connecting the top wall, the bottom wall and the side walls. An inserting room is formed between the top wall, the bottom wall, the side walls and the rear wall for receiving a mating electrical plug. A terminal module receiving space is formed in the bottom wall for receiving the terminal module and a LED module receiving space is formed in the rear wall for receiving the LED module.

The terminal module includes a base containing a plurality of terminals. Each terminal has a body portion. One end of the body portion curves and extends upwardly to form a resiliently contacting portion for mating with the mating electrical plug, the other end of the body portion bends and extends rearwards to form a soldering portion for soldering with the printed circuit board.

The LED module includes a pair of conduction terminals. Each conduction terminal has a post body. One end of the post body bends and extends frontward to form a LED contacting portion for electronically coupling with at least one LED element, the other end of the post body bends rearwards to form a LED soldering portion for soldering with the printed circuit board. Additionally, the soldering portions of the terminals and the LED soldering portions of the conduction terminals are arranged at the same plane for soldering with the printed circuit board by surface mount technology.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
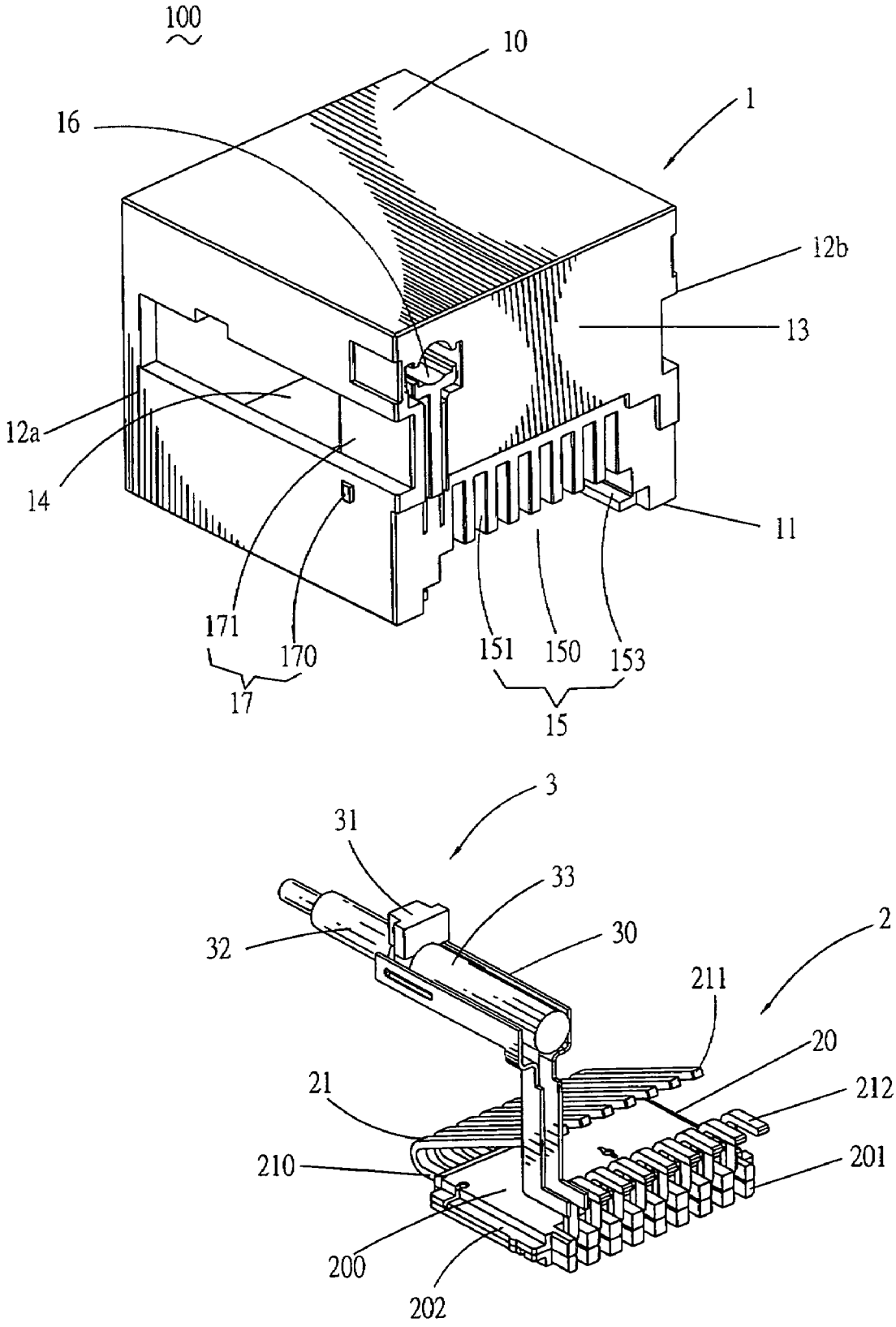
FIG. 1 is an exploded view showing the first preferred embodiment of an electrical connector assembly according to the present invention.

Firstly referring to FIG. 1, the first preferred embodiment of an electrical connector assembly according to the present invention includes an insulating housing 1, a terminal module 2 and at least one light-emitting diode (LED) module 3, which forms an electrical connector 100. The insulating housing 1 has a top wall 10, a bottom wall 11 opposite to the top wall 10, two side walls 12*a*, 12*b* and a rear wall 13 connecting the top wall 10, the bottom wall 11 and the side walls 12*a*, 12*b*. An inserting room 14 is located and surrounded by the top wall 10, the bottom wall 11, the side walls 12*a*, 12*b* and the rear wall 13 for receiving a mating electrical plug (not shown in the figures).

Still referring to FIG. 1, a terminal module receiving space 15 is formed in the bottom wall 11 of the insulating housing 1 for receiving the terminal module 2. At least one LED module receiving space 16 is formed in the rear wall 13 of the insulating housing 1 and closed to the side wall 12*a* for receiving the LED module 3. The terminal module receiving space 15 includes a base receiving space 150 formed in the bottom wall 11 of the insulating housing 1 and opened to the rear wall 13 of the insulating housing 1. A plurality of grooves 151 are formed in the rear wall 13 of the insulating housing 1 and communicated to the base receiving space 150. At least on latch member 153 is arranged at the side of the base receiving space 150 and projects inwardly for engaging the terminal modular 2.

Figure 2:
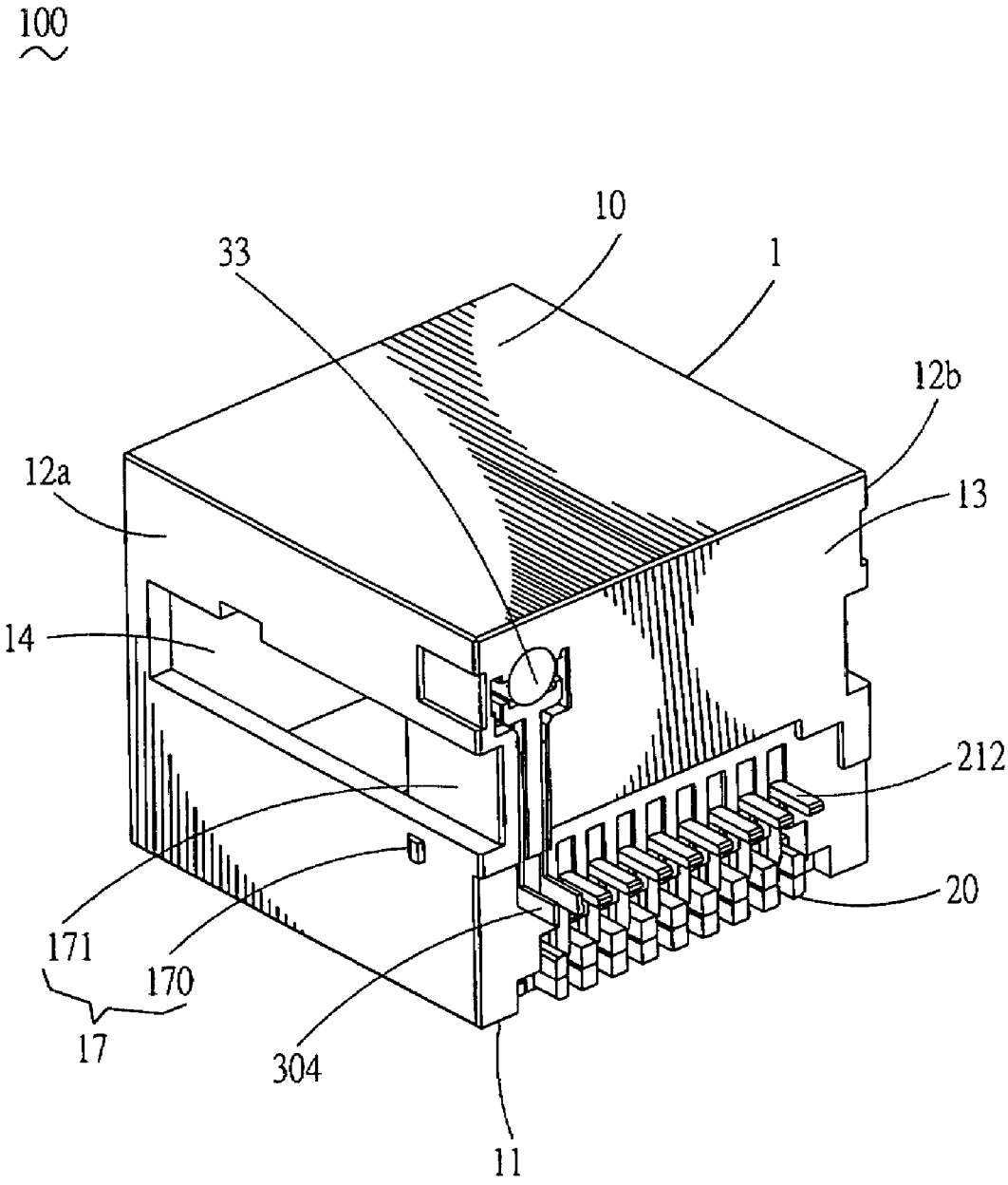
FIG. 2 is a perspective view showing the first preferred embodiment of the electrical connector assembly.

Please refer to FIG. 1 and FIG. 2. The terminal module 2 includes a base 20 received in the base receiving space 150, having a plurality of terminals 21, which is formed by engaging an upper cap 200 and a corresponding lower cap 201. At least one base latch 202 locates at the side of the base 20 for engaging with the latch member 153 of the base receiving space 150. Each terminal 21 has a body portion 210 contained in the base 20. One end of the body portion 210 curves and extends toward the inserting room 14 to form a resiliently contacting portion 211 for electrically coupling with the mating electrical plug. The other end of the body portion 210 bends and extends rearwards to form a soldering portion 212, which is partially contained in the corresponding groove 151 for soldering with the printed circuit board (not shown in the figures).

Figure 3:
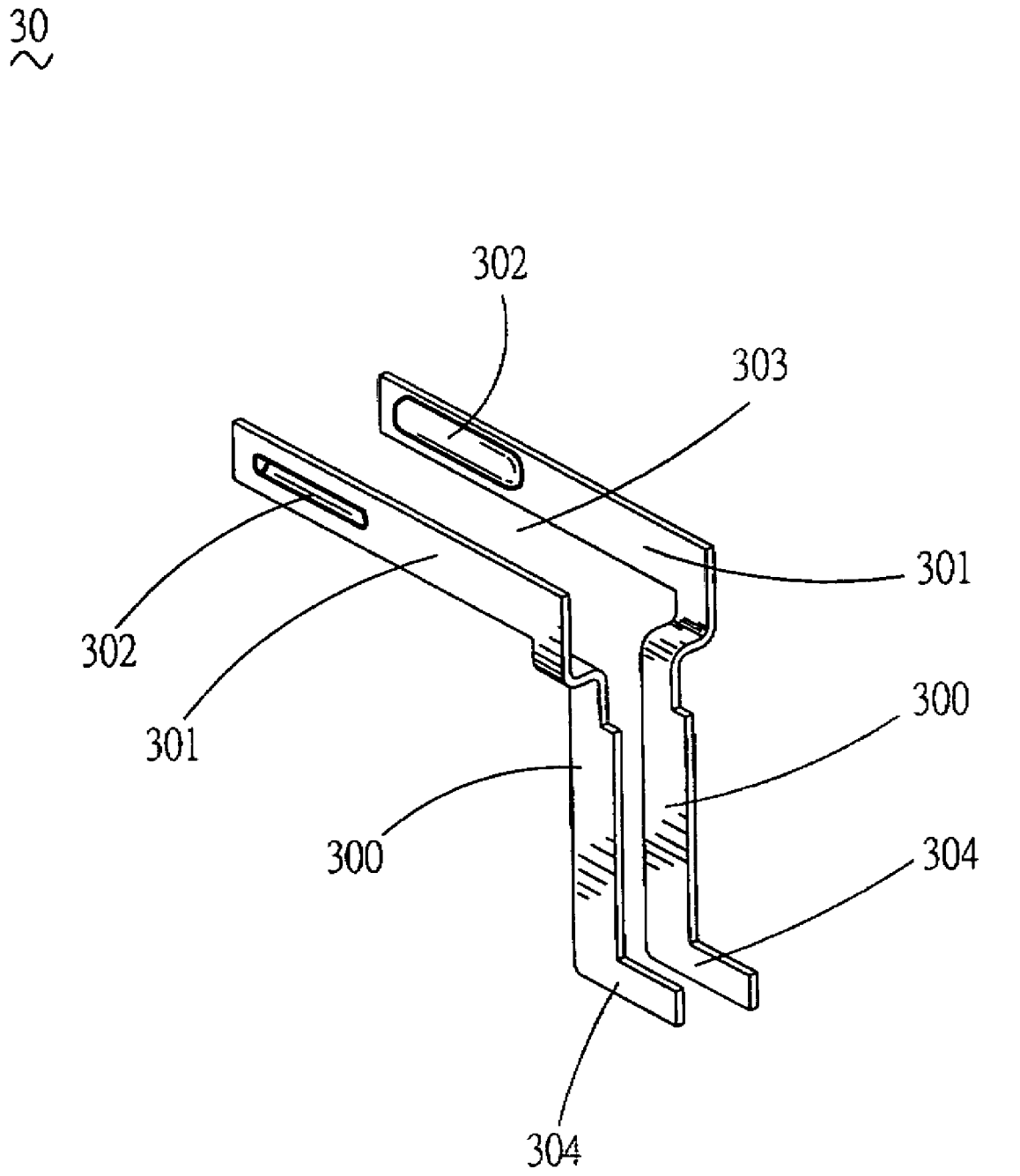
FIG. 3 is a perspective view showing a pair of conduction terminals of the first preferred embodiment of the electrical connector assembly.

Referring to FIG. 1 and FIG. 3, the LED module 3 includes at least one pair of conduction terminals 30. Each conduction terminal 30 has a post body 300. One end of the post body 300 bends outwardly and extends frontward to form a support arm 301. At least one LED contacting portion 302 projects from the support arm 301 for electronically coupling with at least one LED element 31. A support space 303 is formed between each pair of support arm 301 for supporting a block 33 which is arranged at one end of the LED element 31 for fixing the LED element 31. A guide member 32 arranges at the other end of the LED element 31 for light traveling from the LED element 31. The other end of the post body 300 bends and extends rearward to form a LED soldering portion 304 for soldering with the printed circuit board. Additionally, the soldering portions 212 of the terminals 21 and the LED soldering portions 304 of the conduction terminals 30 are arranged at the same plane.

Figure 4:
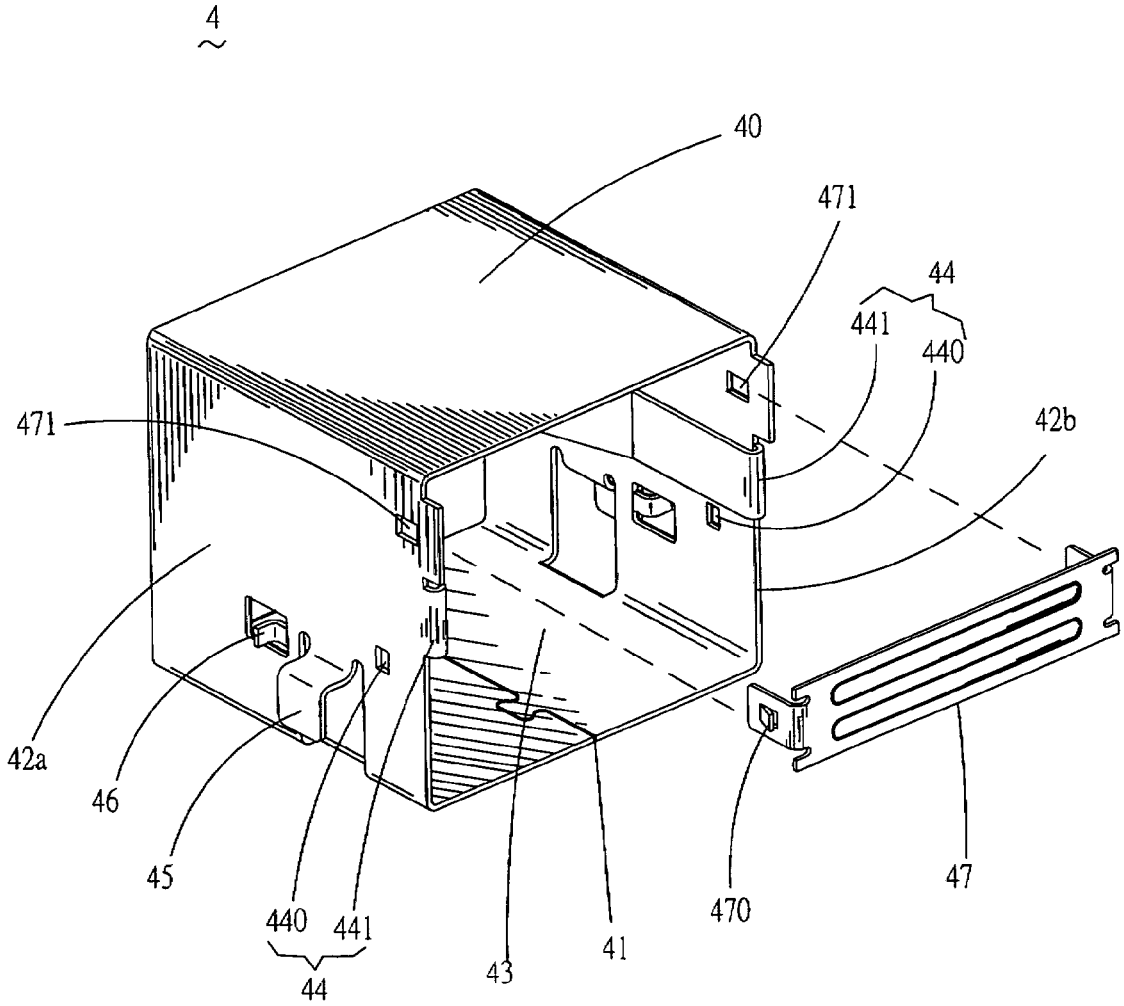
FIG. 4 is an exploded view showing a metal shell of the second preferred embodiment of the electrical connector assembly.
Figure 5:
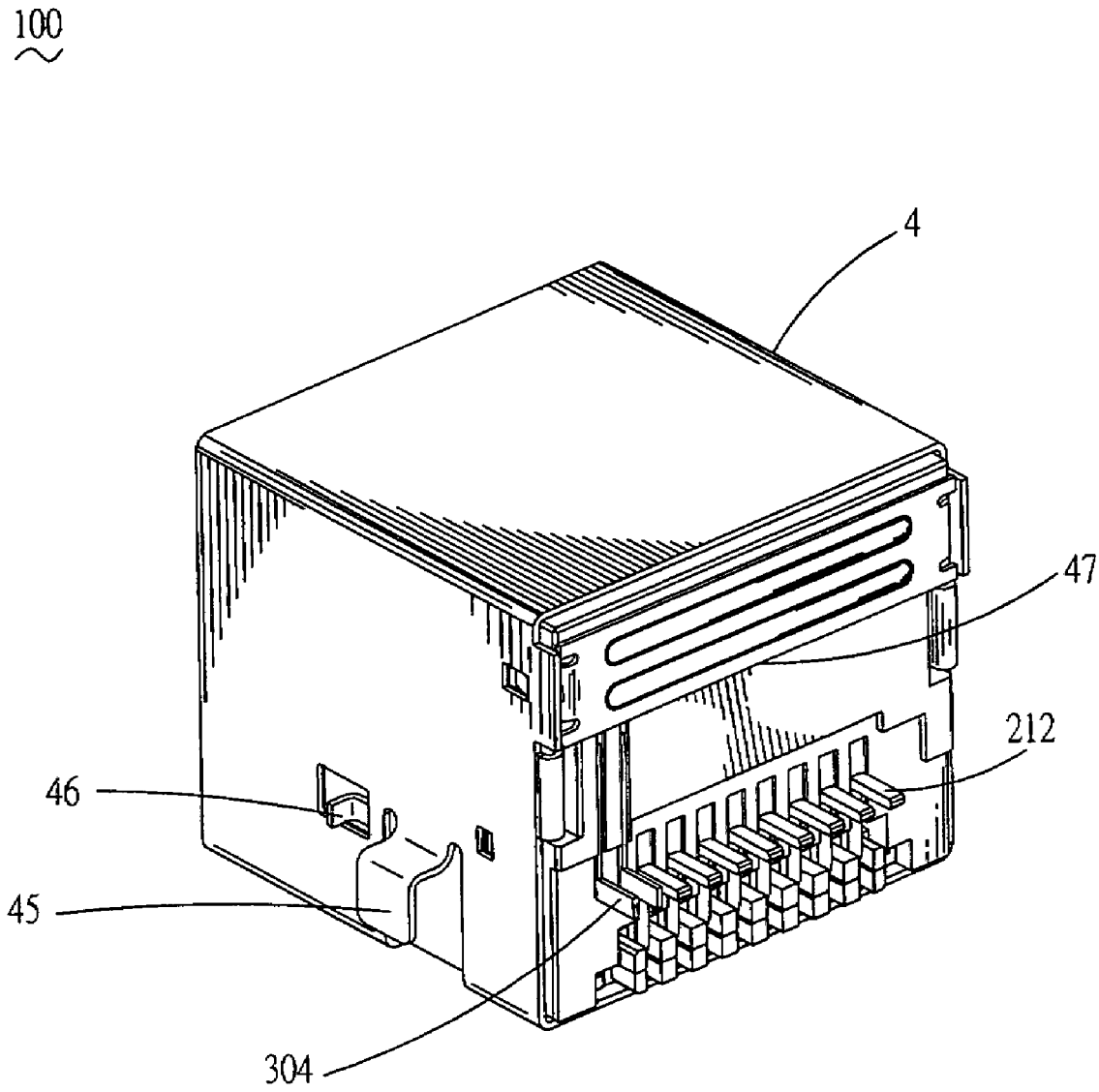
FIG. 5 is a perspective view of the second preferred embodiment of the electrical connector assembly.

As showing in FIG. 4 and FIG. 5, a second preferred embodiment of the electrical connector assembly according to the present invention further includes a metal shell 4 rested on the printed circuit board for covering the insulating housing 1. The metal shell 4 defines a top section 40, a bottom section 41 opposite to the top section 40, and two side sections 42*a*, 42*b* connecting the top section 40 and the bottom section 41. A receiving room 43 is surrounded by the top section 40, the bottom section 41 and two side sections 42*a*, 42*b* for containing the insulating housing 1. At least one shell latch 44 disposes on the side sections 42, 42*b* for engaging with at least one housing latch 17 disposed on the side walls 12*a*, 12*b*. The shell latch 44 includes at least one hole 440 forms in side sections 42*a*, 42*b* of the metal shell 4 for engaging with at least one corresponding projection 170 of the housing latch 17 arranged at the side walls 12*a*, 12*b* of the insulating housing 1. At least one latch piece 441 arranges at free end of the side sections 42*a*, 42*b* and extends inner the receiving room 43 for engaging with at least one corresponding through cavity 171 of the housing latch 17 formed in side walls 12*a*, 12*b* of the insulating housing 1.

Still referring to FIG. 4 and FIG. 5. The metal shell 4 further includes at least one inserting leg 45 arranged at side sections 42*a*, 42*b* for engaging with at least one corresponding groove formed in the printed circuit board. At least one balance arm 46 projects outwardly from the side sections 42*a*, 42*b* for adapting the electrical connector 100 to the printed circuit board. At least one metal shield 47 corresponds to the LED element 31 of the LED module 3 and engages with the metal shell 4 for preventing electromagnetic interference and fixing the block 33 of the LED module 3. The metal shell 47 has at least one shield latch 470 arranged at end of the metal shield 47 for engaging with at least one engagement device 471 formed in the side sections 42*a*, 42*b* of the metal shell 4.

The electrical connector 100 is capable of fast and precisely soldering with the printed circuit board by surface mount technology as a result of the soldering portions 212 of the terminals 21 and the LED soldering portions 304 of the conduction terminals 30 arranged at the same plane. Furthermore, the electrical connector 100 securely rests on the printed circuit board via balance arm 46 and the insert leg 45.

The foregoing description of various implementations has been presented for the purposes of illustration and description. It is not intended to be exhaustive or to limit the scope to the precise form disclosed. Many modifications and variations are possible in light of the above teaching. Such modifications and variations are intended to be included within the scope of this invention as defined by the accompanying claims.

What is claimed is:

1. An electrical connector assembly for soldering with a printed circuit board and electrically coupling with a mating electrical plug comprising:

an insulating housing comprising a terminal module receiving space and at least one light-emitting diode module receiving space;

a terminal module contained in said terminal module receiving space comprising a base receiving a plurality of terminals, each terminal comprising a body portion, one end of said body portion bent and extended upwardly to form a resiliently contacting portion for electronically coupling with said mating electrical plug, the other end of said body portion extended to form a soldering portion for soldering with said printed circuit board; and at least a light-emitting diode module contained in said light-emitting diode module receiving space comprising at least a pair of conduction terminals, each conduction terminal comprising a post body, one end of said post body extending frontward to form a light-emitting diode contacting portion for electronically coupling with at least one light-emitting diode element, the other end of said post body bent to form a light-emitting diode soldering portion for soldering with said printed circuit board, said soldering portions of said terminals of said terminal module and said light-emitting diode soldering portions of said conduction terminals of said light-emitting diode module arranged at the same plane.

2. The electrical connector assembly as claimed in claim 1, wherein said insulating housing comprises a top wall, a bottom wall, two side walls, and a rear wall connecting said top wall, said bottom wall and said side walls, an inserting room surrounded by said top wall, said bottom wall, said side walls and said rear wall, for receiving said mating electrical plug.

3. The electrical connector assembly as claimed in claim 2, wherein said terminal module receiving space is formed in said bottom wall comprising a base receiving space formed in said bottom wall and opened to said side wall, a plurality of grooves formed in said rear wall and communicating to said base receiving space.

4. The electrical connector assembly as claimed in claim 2, wherein said light-emitting module receiving space is formed in said rear wall and closed to said side wall.

5. The electrical connector assembly as claimed in claim 3, wherein said terminal module receiving space further comprises at least one latch member arranged at said base receiving space and projected inwardly for engaging with said terminal modular.

6. The electrical connector assembly as claimed in claim 1, wherein said base of said terminal module is formed by engaging with an upper cap and a lower cap.

7. The electrical connector assembly as claimed in claim 5, wherein said base of said terminal module comprises at least one base latch arranged at side of said base for engaging with said latch member of said base receiving space.

8. The electrical connector assembly as claimed in claim 1, wherein said light-emitting diode module comprises at least one guide member arranged at one end of said light-emitting diode element for light traveling from said light-emitting diode element.

9. The electrical connector assembly as claimed in claim 1, wherein said light-emitting diode module comprises at least one block arranged at one end of said light-emitting diode element for fixing said light-emitting diode element.

10. The electrical connector assembly as claimed in claim 1, further comprising a metal shell which includes a top section, a bottom section opposite said top section, two side sections connecting said top section and said bottom section, a receiving room surrounded by said top section, said bottom section and side sections for containing said insulating housing.

11. The electrical connector assembly as claimed in claim 1, wherein said metal shell comprises at least one shell latch disposed on said side section for engaging with at least one housing latch of said insulating housing disposed on said side wall of said insulating housing.

12. The electrical connector assembly as claimed in claim 11, wherein said shell latch comprises at least one latch hole formed in said side section for engaging with at least one projection of said housing latch arranged at said side wall of said insulating housing.

13. The electrical connector assembly as claimed in claim 11, wherein said shell latch comprises at least one latch piece arranged at free end of said side section and extended inwardly into said receiving room for engaging with at least one corresponding through cavity of said housing latch formed in said side wall of said insulating housing.

14. The electrical connector assembly as claimed in claim 11, wherein said metal shell comprises at least one inserting leg arranged at said side section for engaging with at least one corresponding groove formed in said printed circuit board.

15. The electrical connector assembly as claimed in claim 11, wherein said metal shell comprises at least one balance arm projected outwardly from said side section for adapting said electrical connector assembly to said printed circuit board.

16. The electrical connector assembly as claimed in claim 11, wherein said metal shell comprises at least one metal shield corresponded to said light-emitting element of said light-emitting module and engaged with said metal shell.

17. The electrical connector assembly as claimed in claim 16, wherein said metal shell comprises at least one shield latch arranged at an end of said metal shield for engaging with at least one engagement device formed in said side section of said metal shell.

* * * * *